United States Patent [19]

Ono et al.

[11] 4,182,300

[45] Jan. 8, 1980

[54] TROUBLE WARNING DEVICE FOR AN AIR-FUEL RATIO SENSOR

[75] Inventors: Hironobu Ono; Minoru Bito, both of Toyota, Japan

[73] Assignee: Toyota Judosha Kogyo Kabushiki Kaisha, Aichi, Japan

[21] Appl. No.: 874,332

[22] Filed: Feb. 1, 1978

[30] Foreign Application Priority Data

Feb. 1, 1977 [JP] Japan ..... 52-9186

[51] Int. Cl.[2] ..... F02B 77/08

[52] U.S. Cl. ..... 123/198 D; 123/32 EE; 123/119 EC

[58] Field of Search ..... 123/198 D, 119 EC, 32 EE; 60/276, 277

[56] References Cited

U.S. PATENT DOCUMENTS

| | | | |
|---|---|---|---|
| 3,903,853 | 9/1975 | Kizler | 60/276 |
| 3,948,228 | 4/1976 | Luchaco | 60/276 |
| 3,962,866 | 6/1976 | Neidhard et al. | 60/276 |
| 4,007,589 | 2/1977 | Neidhard et al. | 60/276 |
| 4,027,477 | 6/1977 | Storey | 60/276 |
| 4,029,061 | 6/1977 | Asano | 60/276 |
| 4,057,042 | 11/1977 | Aono | 60/276 |

*Primary Examiner*—Ira S. Lazarus

*Attorney, Agent, or Firm*—Stevens, Davis, Miller & Mosher

[57] ABSTRACT

Disclosed is a trouble warning device for an air-fuel ratio sensor mounted in an internal combustion engine. The trouble warning device comprises a comparator which compares the output voltage level of the air-fuel ratio sensor with a reference voltage whose level is higher than the output voltage level of the normally operating air-fuel ratio sensor and an indicator to give warning of trouble in response to the compared result. By using this trouble warning device, correct detection of trouble and reliable warning of trouble in the air-fuel ratio sensor can be obtained.

6 Claims, 3 Drawing Figures

TROUBLE WARNING DEVICE FOR AN AIR-FUEL RATIO SENSOR

BACKGROUND OF THE INVENTION

This invention relates to a trouble warning device which gives warning of trouble in an air-fuel ratio sensor mounted in an internal combustion engine.

There is known an air-fuel ratio feedback control system for controlling the air-fuel ratio (A/F ratio) in the exhaust gas of an internal combustion engine so that it is a stoichiometric A/F ratio. In this system, an air-fuel ratio sensor (A/F ratio sensor), for example, an oxygen concentration sensor is included in an exhaust system of the engine to detect the A/F ratio in the exhaust gas. A sensed signal from the A/F ratio sensor is fed to an electronic fuel injection control means to correct the amount of fuel injected into the engine, or fed to a secondary air injection control means to control the amount of secondary air injected into the engine so as to effect the above A/F ratio control. If a three way catalytic converter capable of simultaneously eliminating three harmful components, i.e., HC, CO and $NO_x$, were to be combined with this air-fuel ratio feedback control system, it would seem to be possible to obtain a purified exhaust gas. This is because the operation of this three way catalytic converter is effectively attained when the A/F ratio of the exhaust gas introduced into the converter is kept near the stoichiometric A/F ratio.

An A/F ratio sensor used in the above-mentioned system, to which a constant current should be provided, generally generates an output voltage of about 1 V when the A/F ratio in the atmosphere of the sensor is smaller than the stoichiometric A/F ratio, namely when the atmosphere is rich, and; it generally generates an output voltage of about 0.1 through 0.2 V when the A/F ratio in the atmosphere of the sensor is greater than the stoichiometric A/F ratio, namely when the atmosphere is lean. However, when the A/F ratio sensor malfunctions, the level of the output voltage thereof becomes approximately as high as the level of a source voltage provided from a voltage supply, for example, a battery which is mounted in the engine.

In a known system for giving warning of trouble in the A/F ratio sensor, a comparator disposed in the electronic fuel injection control means, or in the secondary air injection control means, so as to control the A/F ratio of the exhaust gas has been used to also detect trouble in the A/F ratio sensor. However, according to this known system, since the reference voltage level of the comparator is low (about 0.5 V), it is difficult to discriminate whether trouble in the A/F ratio sensor has occurred or the atmosphere of the A/F ratio sensor has become rich. Therefore, an error in detection of trouble in the A/F ratio sensor has often occurred in the known system.

SUMMARY OF THE INVENTION

It is, therefore, an object of the present invention to provide a trouble warning device for giving warning of trouble in an air-fuel ratio sensor, by which correct detection of trouble and reliable warning of trouble in the air-fuel ratio sensor can be obtained.

According to the present invention, the trouble warning device for an air-fuel ratio sensor mounted in an internal combustion engine comprises: a means for generating a reference voltage, the level of which is higher than the maximum level of an output voltage of the air-fuel ratio sensor in normal operation; a means for comparing the level of an output voltage of the air-fuel ratio sensor with the level of the reference voltage provided from the aforementioned generating means, and; an indicating means for giving warning of trouble in response to a compared result fed from the aforementioned comparing means.

In a preferred embodiment according to the present invention, the indicating means is energized to give warning of trouble when the output voltage level of the air-fuel ratio sensor becomes higher than the reference voltage level.

In another preferred embodiment, the trouble warning device further comprises a means for de-energizing the aforementioned indicating means when the air-fuel ratio sensor is inactive.

The above-mentioned and other related objects and features of the present invention will be apparent from the description set forth below, with reference to the accompany drawings, and from the appended claims.

DETAILED DESCRIPTION OF THE INVENTION

Figure 1:
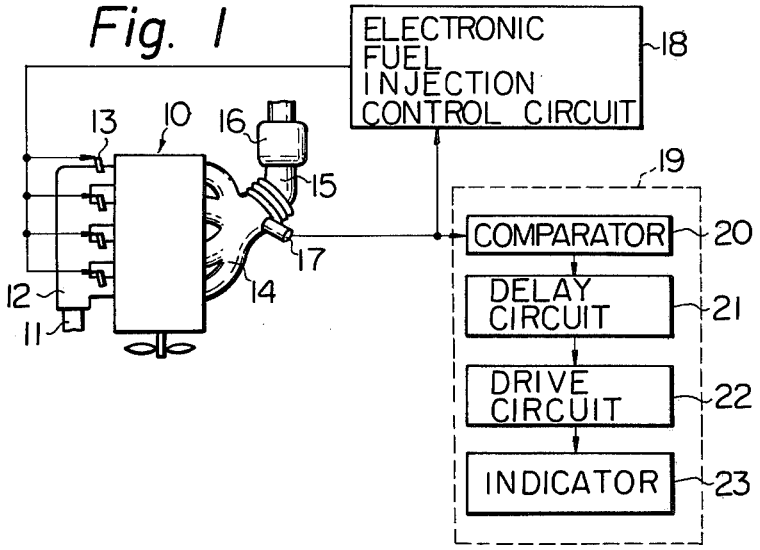
FIG. 1 is a schematic view of an internal combustion engine of an electronic fuel injection type provided with a trouble warning device according to the present invention.

Referring to FIG. 1, which is a schematic view of an internal combustion engine of an electronic fuel injection type provided with a trouble warning device according to the present invention, numeral 10 designates an engine body. Intake air is introduced into the combustion chambers (not shown) in the engine body 10, via an intake pipe 11 and an intake manifold 12. Fuel injection valves 13 mounted on the intake manifold 12 can provide the combustion chambers with fuel fed from a fuel supply mechanism (not shown). Resultant exhaust gas, due to the combustion in each of the combustion chambers, is introduced through an exhaust manifold 14 into an exhaust pipe 15 connected thereto. A three way catalytic converter 16 is disposed in the exhaust pipe 15.

Numeral 17 designates an air-fuel ratio sensor for sensing the atmosphere of the exhaust gas, in other words, for sensing the A/F ratio of the exhaust gas in the exhaust pipe 15 or in the exhaust manifold 14. The sensor 17 to which a constant current should be provided is composed of, for example, the above-mentioned oxygen concentration sensor which operates to detect the concentration of oxygen in the exhaust gas and to provide an electrical signal of a low level (about 0.1–0.2 V) or of a high level (about 1.0 V) according to the A/F ratio of the exhaust gas. This type of the sensor 17 is already known from, for example U.S. Pat. No. 3,938,479.

In accordance with the low or high levels of the electrical signal provided from the air-fuel (A/F) ratio sensor 17, an electronic fuel injection control circuit 18 controls the duration of pulses fed to the fuel injection valves 13 in order to decrease or increase the amount of fuel introduced into the combustion chambers via the injection valves 13 and the intake manifold 12, so that the A/F ratio of the exhaust gas introduced into the three way catalytic converter 16 is controlled so as to be near the stoichiometric A/F ratio.

Numeral 19 designates a trouble warning device according to the present invention. This device 19 includes a comparator 20 which receives the output voltage of the A/F ratio sensor 17 and compares the level thereof with the level of a predetermined reference voltage. The compared result provided from the comparator 20 is time-delayed by a delay circuit 21 in the device 19 when a malfunction of the A/F ratio sensor 17 is detected. The time-delayed signal is applied to a drive circuit 22 in the device 19 so as to energize an indicator 23 for giving warning of trouble in the A/F ratio sensor 17.

Figure 2:
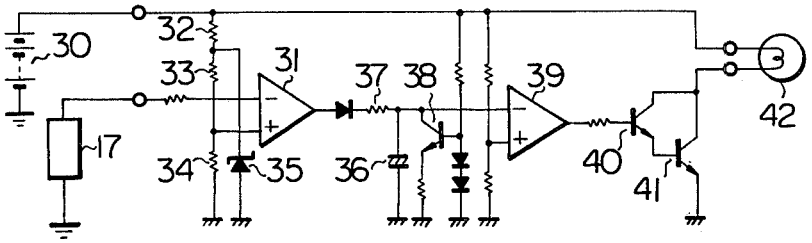
FIG. 2 is a circuit diagram of the trouble warning device illustrated in FIG. 1.

FIG. 2 is a detailed circuit diagram of the trouble warning device illustrated in FIG. 1, which is an embodiment according to the present invention. In FIG. 2, numeral 30 is a battery mounted in the engine, and 17 is the A/F ratio sensor described above. The output terminal of the A/F ratio sensor 17 is connected to an inverting input terminal of an operational amplifier 31, which forms the aforementioned comparator 20. To a non-inverting input terminal of the operational amplifier 31, a reference voltage supply circuit is connected. This reference voltage supply circuit comprises resistors 32, 33 and 34, which are connected in series and which are inserted between the two terminals of the battery 30, and a constant-voltage diode 35, for example, a zener diode, which is connected in parallel with the resistors 33 and 34 so as to provide the non-inverting input terminal with a constant-level voltage. An output terminal of the operational amplifier 31 is connected to one terminal (positive terminal) of a capacitor 36 through a resistor 37. The other terminal of the capacitor 36 is grounded. A transistor 38 is connected in parallel with the capacitor 36 to form a constant-current discharging circuit. The positive terminal of the capacitor 36 is connected to an inverting input terminal of an operational amplifier 39, which forms a second comparator, to compare the input voltage level with the level of a reference voltage applied to a non-inverting input terminal thereof. The resistor 37, the capacitor 36, the constant current discharging circuit which includes the transistor 38, and the second comparator which includes the operational amplifier 39, form the aforementioned delay circuit 21 illustrated in FIG. 1.

An output terminal of the operational amplifier 39 is connected to a series of switching transistors 40 and 41 which are directly connected to each other to form the drive circuit 22 illustrated in FIG. 1. An indicator lamp 42 is connected between the collector of the transistor 41 and the positive terminal of the battery 30 so as to be energized when both of the transistors 40 and 41 conduct.

The operation of the trouble warning device according to the present invention will now be described.

The reference voltage level of the comparator 20 is previously set to a level, for example, 6 V, which is sufficiently higher than the level of the output voltage, such as 0.1 through 1.0 V, provided from the normally operating A/F ratio sensor 17, and which is lower than the output voltage level of the battery 30. When the A/F ratio sensor 17 operates normally, since the maximum output voltage level of the A/F ratio sensor 17 is 1 V at most, as described above, the output level of the operational amplifier 31 is high. Therefore, the capacitor 36 is fully charged in spite of the discharging operation by means of the aforementioned constant-current discharging circuit. Accordingly, the output level of the operational amplifier 39 is low and both of the switching transistors 40 and 41 are in the off state, and therefore, the indicator lamp 42 is not energized.

When the A/F ratio sensor 17 malfunctions, since the output voltage level thereof rises approximately as high as the output voltage level of the battery 30, the output level of the operational amplifier 31 becomes low. Therefore, the charging operation of the capacitor 36 is stopped and only the discharging operation by means of the constant-current discharging circuit is maintained. When the terminal voltage level of the capacitor 36 drops below the reference voltage level of the secondary comparator (the operational amplifier 39), the output level of the operational amplifier 39 becomes high. Accordingly, both of the switching transistors 40 and 41 conduct and the indicator lamp 42 is energized so as to give warning of trouble in the A/F ratio sensor 17.

The A/F ratio sensor in the inactive state behaves as if it has malfunctioned. This is because, when the sensor is inactive, the internal impedance thereof generally becomes high and, as a result, the output voltage level thereof becomes high. Therefore, conventionally it is normally difficult to discriminate whether trouble in the A/F ratio sensor has occurred or the A/F ratio sensor is inactive by comparing the output voltage level of the sensor with the reference voltage level. In the trouble warning device according to the present invention, therefore, the delay circuit 21, which includes the capacitor 36, the transistor 38 and the operational amplifier 39, is arranged so as to de-energize the indicator 23 when the A/F ratio sensor 17 is inactive. Since the inactive state of the A/F ratio sensor occurs for a certain period of time after the engine is started, a timer of constant-current discharging type, which comprises the capacitor 36 and the constant-current discharging circuit including the transistor 38, operates so that the output level of the operational amplifier 39 is at a low level during the period T indicated in FIG. 3. However, the delay circuit 21 can be eliminated in an embodiment according to the present invention if an A/F ratio sensor which is active at all times is used.

Figure 3:
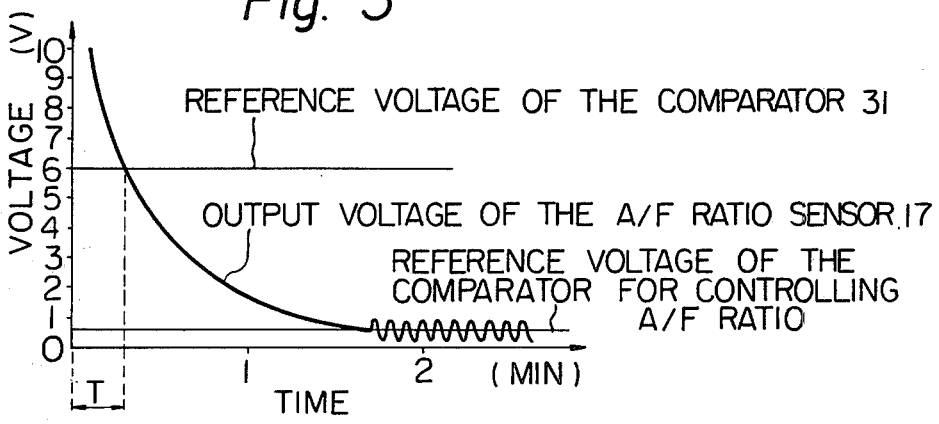
FIG. 3 is a graph illustrating an output voltage characteristic of an air-fuel ratio sensor and reference voltage characteristics of comparators.

FIG. 3 illustrates the output voltage characteristic of the A/F ratio sensor 17 in FIGS. 1 and 2, the reference voltage characteristics of the comparator 20 in FIG. 1 and of the known comparator disposed in the electronic fuel injection control circuit 18 in FIG. 1. In FIG. 3, the voltages are indicated as functions of the time elapsed after the engine is started.

As will be apparent from FIG. 3 and the foregoing description, since the level of the reference voltage of the comparator 31 in the trouble warning device according to the present invention is set sufficiently higher than (about ten times higher than) the level of the reference voltage of the comparator, which is disposed in the electronic fuel injection control circuit, in order to control the A/F ratio of the exhaust gas, correct detection of trouble and reliable warning of trouble in the A/F ratio sensor can be obtained by using the trouble warning device according to the present invention. Furthermore, since the indicator 23 is unconditionally de-energized during the period T from the time the engine is started, detection of non existant trouble in the A/F ratio sensor which is inactive can be prevented.

In the foregoing embodiments, the trouble warning device is used to give warning of trouble in the air-fuel ratio sensor mounted in the internal combustion engine of the electronic fuel injection control type. However, the trouble warning device of the present invention may also be used to give warning of trouble in the air-fuel ratio sensor used in the internal combustion engine of the secondary air injection control type.

As many widely different embodiments of the present invention may be developed without departing from the spirit and scope of the present invention, it should be understood that the present invention is not limited to the specific embodiments described in this specification, except as defined in the appended claims.

What is claimed is:

1. A trouble warning device for an air-fuel ratio sensor mounted in an internal combustion engine, said air-fuel ratio sensor in normal operation generating electrical signals having a first voltage level which indicates one air-fuel ratio condition of the engine and a second voltage level which indicates another air-fuel ratio condition of the engine, said trouble warning device comprising:

means for generating a reference voltage having a level higher than both the first and second voltage levels of the normal electrical signals;

means for comparing the voltage level of an electrical signal generated by said air-fuel ratio sensor with the level of the reference voltage from said generating means; and means for informing an operator of the engine of an occurrence of trouble in said air-fuel ratio sensor when an output signal is received from said comparing means, said output signal indicating that the voltage level of said electrical signal is higher than the level of said reference voltage.

2. A trouble warning device as claimed in claim 1, wherein said generating means comprises a battery of the engine and a voltage divider having at least two resistors connected in series between the output terminals of said battery.

3. A trouble warning device as claimed in claim 1, wherein said comparing means comprises a comparator for generating a trouble signal having a predetermined voltage level when the voltage level of said electrical signal fed from said air-fuel ratio sensor is higher than the level of the reference voltage.

4. A trouble warning device as claimed in claim 3, wherein said informing means is energized by the trouble signal received from said comparator so as to inform an operator of the engine of an occurrence of trouble in said air-fuel ratio sensor.

5. A trouble warning device as claimed in claim 1, further comprising means for inhibiting said informing means from being energized for a predetermined period of time after the engine is started.

6. A trouble warning device as claimed in claim 5, wherein said inhibiting means comprises a charging-discharging capacitor and a constant-current discharging circuit electrically connected across said capacitor, whereby said output signal fed from said comparing means will not be applied to said informing means for a predetermined period of time after the engine is started.

* * * * *